United States Patent [19]

Carlson et al.

[11] Patent Number: 4,838,035

[45] Date of Patent: Jun. 13, 1989

[54] CONTINUOUS CRYOPUMP WITH A METHOD FOR REMOVAL OF SOLIDIFIED GASES

[75] Inventors: Larry W. Carlson, Oswego; Harold Herman, Park Forest, both of Ill.

[73] Assignee: The United States of America as represented by the United States Department of Energy, Washington, D.C.

[21] Appl. No.: 190,567

[22] Filed: May 5, 1988

[51] Int. Cl.[4] ..... B01D 8/00

[52] U.S. Cl. ..... 62/55.5; 55/269; 62/100; 62/268; 417/901

[58] Field of Search ..... 62/55.5, 100, 268; 417/901; 55/269

[56] References Cited

U.S. PATENT DOCUMENTS

| | | | |
|---|---|---|---|
| 4,339,680 | 7/1982 | Flecher et al. | 62/55.5 |
| 4,449,373 | 5/1984 | Peterson et al. | 62/55.5 |
| 4,475,349 | 10/1984 | Batzer et al. | 62/55.5 |
| 4,506,513 | 3/1985 | Max | 62/55.5 |
| 4,530,250 | 7/1985 | Gay et al. | 62/55.5 |
| 4,559,787 | 12/1985 | Batzer et al. | 62/55.5 |
| 4,724,677 | 2/1988 | Foster | 62/55.5 |

OTHER PUBLICATIONS

Foster, C. A., "High-Throughput Continuous Cryopump", J. Vac. Sci. Tech., A5(4), Jul./Aug. 1987.

*Primary Examiner*—Ronald C. Capossela

*Attorney, Agent, or Firm*—Helen S. Cordell; John M. Albrecht; William R. Moser

[57] ABSTRACT

An improved cryopump for the removal of gases from a high vacuum, comprising a cryopanel incorporating honeycomb structure, refrigerant means thermally connected to the cryopanel, and a rotatable channel moving azimuthally around an axis located near the center of the cryopanel, removing gases absorbed within the honeycomb structure by subliming them and conducting them outside the vacuum vessel.

16 Claims, 3 Drawing Sheets

CONTINUOUS CRYOPUMP WITH A METHOD FOR REMOVAL OF SOLIDIFIED GASES

CONTRACTUAL ORIGIN OF THE INVENTION

The U.S. Government has rights in this invention pursuant to Contract No. W-31-109-ENG-38 between the U.S. Department of Energy and the University of Chicago.

BACKGROUND OF THE INVENTION

This invention relates to a cryopump and more particularly to a novel method and apparatus for removing gases from a high vacuum environment.

The semiconductor and metallurgical industries among others require a vacuum facility that can be operated at a relatively high vacuum, in the range of $10^{-4}$ to $10^{-6}$ Torr (where a Torr is 1/760th of atmospheric pressure). Cryopumps are frequently used to remove gases from work spaces, because they operate effectively at high vacuum when external heat losses are minimized.

Cryopumps use a refrigerative process to enhance and maintain high vacuum environments. Sub-atmospheric gases with relatively high vaporization temperatures are passed over a cold surface in the range of 77 to 20 degrees Kelvin, resulting in such gases being deposited on the cold surface in the form of fluid or as a solid, commonly referred to as "ice". The cold surface, called a "cryopanel", thus removes (i.e. "pumps") gases from the environment by the process of condensation, termed "cryocondensation", and the process of adsorption, termed "cryosorption".

In the prior art, the effectiveness of the cryopump is diminished by the accumulation of ice on the cryopanel. During the first stages of accumulation, the pumping action simply slows, removing less gas per unit of time. Eventually accumulation of ice progresses to a point where gas removal is slowed to a degree that system pressure rises above a desired level. Further system operation requires that the system be shut down and "regenerated" by allowing the cryopanel to return to a higher temperature so that solidified gases may sublimate, be released, and pumped from the system by other means.

Continuous cryopumping (in the sense that the high vacuum remains unbroken) is accomplished in most cases by operating batch type cryopumps, alternately regenerating first one and then the other. Much of the prior art is thus devoted to increasing the cryopumping system's effectiveness by minimizing the accumulation of solidified gas.

One way to delay regeneration is to over-design the cryopump. Given two cryopumps of different sizes, removing the same gas load, the smaller pump will need regeneration before the larger pump. Common practice, therefore, is to build large cryopumps with large adsorption capacities.

The throttle valve method of the prior art is also based upon the cryopump being over-designed for a given application. Gas flow to the cryopump surface is restricted, which in effect is equivalent to reducing pumping speed and, therefore, extending time between regenerations. Continuous long term cryopumping is not a feature. The double stage pumping method of the prior art emphasizes differential pumping of water vapor and inert gases, as distinct from continuous long-term high through-put. However, high speed pumping of low condensing temperature gases is severely restricted by using staged pumping. (For a discussion of these methods, see U.S. Pat. No. 4,449,373, issued May 22, 1984, and U.S. Pat. No. 4,475,349, issued Oct. 9, 1984.)

A more recent method in the prior art uses a cylindrical chamber and a scraper moving in a helical motion around and up the walls of the inside of the chamber. The scraper chips ice from the surface and exhausts it as a solid or gas. While this method accomplishes cryopumping without the need for shutdown for regeneration, pressure fluctuations result from the reciprocal motion of the scraper and the geometry of the cryopanel. (U.S. Pat. No. 4,724,677 issued Feb. 16, 1988. See further, Foster, "High-Throughout Continuous Cryopump," J. Vac. Sci. Technol. A5(4), July/August 1987.)

It is an object of applicants' invention to provide an improved cryopumping system for removing solidified gases from a high vacuum environment without the need for a shutdown to accomplish regeneration.

It is another object of this invention to provide a cryopumping system from which solidified gases are removed at an average rate substantially equal to the rate at which they are deposited so that vacuum pressure is substantially constant.

It is another object of this invention to provide an improved cryopumping system that minimizes the heat transfer from the cryopanel to the refrigerant flow.

It is another object of this invention to provide a method for reducing the required physical dimensions of the cryopanel.

Additional objects, advantages and novel features of the invention will become apparent to those skilled in the art upon examination of the following and by practice of the invention.

SUMMARY OF THE INVENTION

To achieve the foregoing and other objects, this invention comprises a novel improved cryopump for the condensation and adsorption of gases in a high vacuum. The improved cryopump comprises a cryopanel incorporating honeycomb structure having a multitude of individual cells separated by their walls or partitions extending generally normal to the plane of the cryopanel to form a cryopanel surface, refrigerant means including closed tubes for accommodating the flow of low temperature refrigerant thermally connected to the cryopanel, and a rotatable channel which moves over the cryopanel surface.

The rotatable channel moves azimuthally around an axis located at the center of the cryopanel. In the channel is located a heat source such as a resistance heater. Solidified gas exposed to the heater's radiant energy is sublimed, and then moves as a gas through the channel to a vacuum pump located outside the vacuum vessel.

Sliding lip seals are used along the edges of the channel to minimize leakage of gas into the vacuum chamber.

BRIEF DESCRIPTION OF THE DRAWINGS

The present invention is illustrated in the accompanying drawing where.

DETAILED DESCRIPTION OF THE INVENTION

Figure 1:
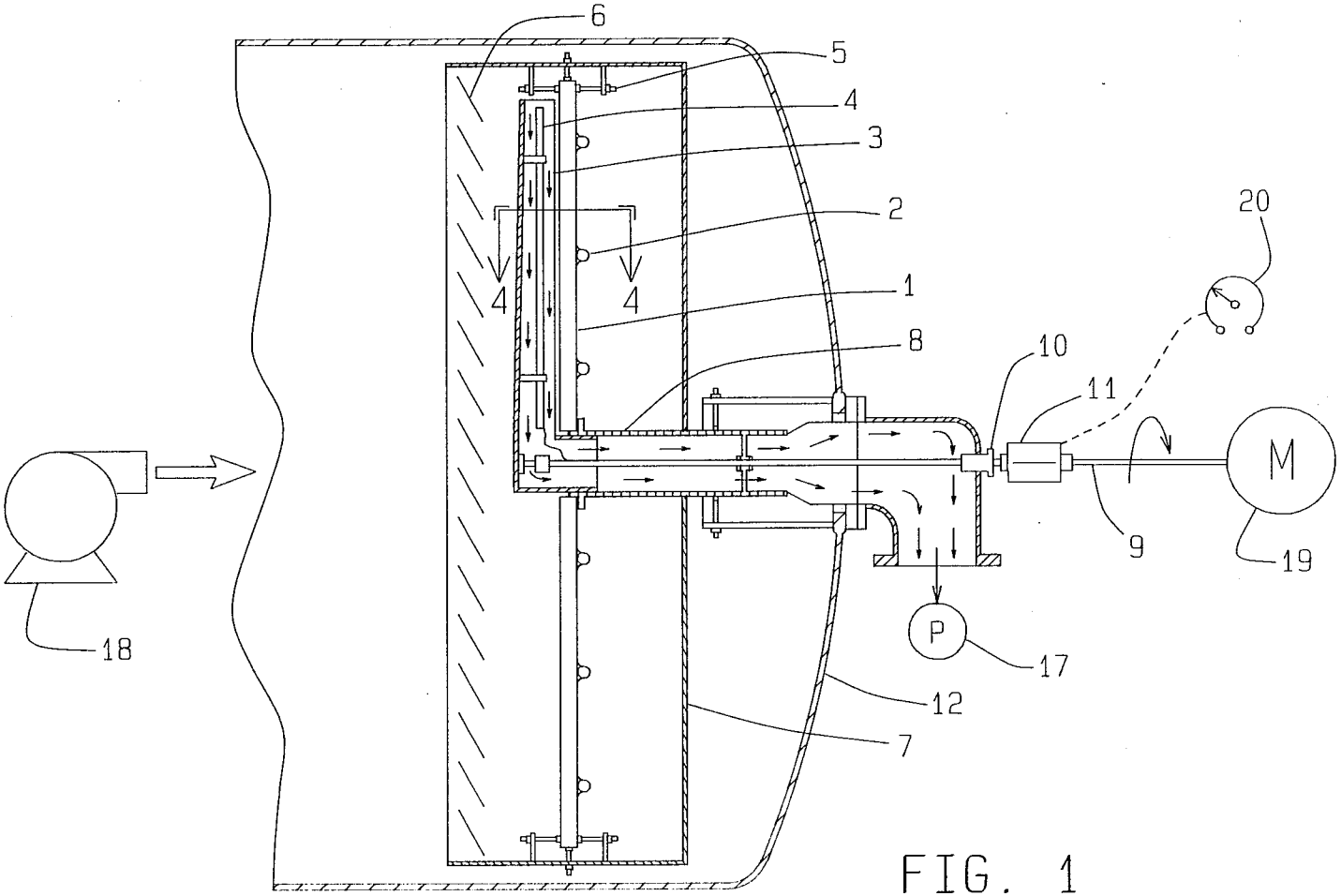
FIG. 1 is a section of the improved cryopumping system herein disclosed.

Referring to the drawings, FIG. 1 shows a section of the improved cryopumping system. A condensible gas such as argon is introduced into a vessel 12 which has been partially evacuated by a complementary pumping system 18 to approximately $10^{-4}$ Torr. As is well known in the prior art, high transmission baffles 6 cooled by a refrigerant such as liquid nitrogen provide high conductance thermal shielding to the circular cryopanel 1. The cryopanel 1 is mounted within the vessel 12 by means of a low heat leak support 5, as is well known in the prior art.

Refrigerant tubes 2 substantially in contact with and thermally connected to the rear surface of the cryopanel 1 pass a low temperature refrigerant such as gaseous helium at 20 degrees Kelvin, drawing heat from the cryopanel 1 and reducing its surface temperature to 30 to 20 degrees Kelvin. Argon is solidified on the surface of the cryopanel 1, and the work space pressure is reduced to $10^{-6}$ Torr or lower.

A radially directed open flow channel 3 is positioned in front of and in juxtaposition to the cryopanel 1. Inside the channel 3 is a radiant cartridge heater 4, mechanically supported by ceramic supports and powered by means of a variable speed motor 19 through electric leads from slip rings 11 on the drive shaft 9. A rheostat 20 varies the power input to the cartridge heater 4. The drive shaft 9, sealed by a rotary vacuum seal 10, is adapted to rotate the channel 3, sequentially to expose segments of the cryopanel 1 to radiant energy emanating from within the channel. Solidified argon is sublimed and moves through a fixed duct 8 toward a blower/mechanical pump combination 17. A liquid nitrogen shield 7, well known in the prior art, separates refrigerant tubes 2 and the cryopanel 1 from the interior of vacuum vessel 12.

Figure 2:
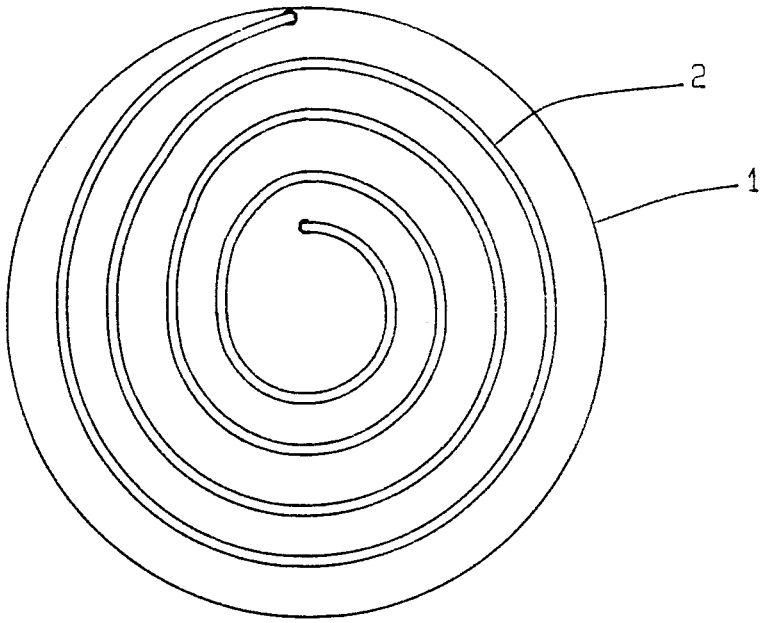
FIG. 2 is a view looking at the rear of the cryopanel.

FIG. 2 is a view looking at the rear of the cryopanel 1. A low temperature refrigerant flows through the refrigerant tubes 2, drawing heat from the cryopanel 1.

Figure 3:
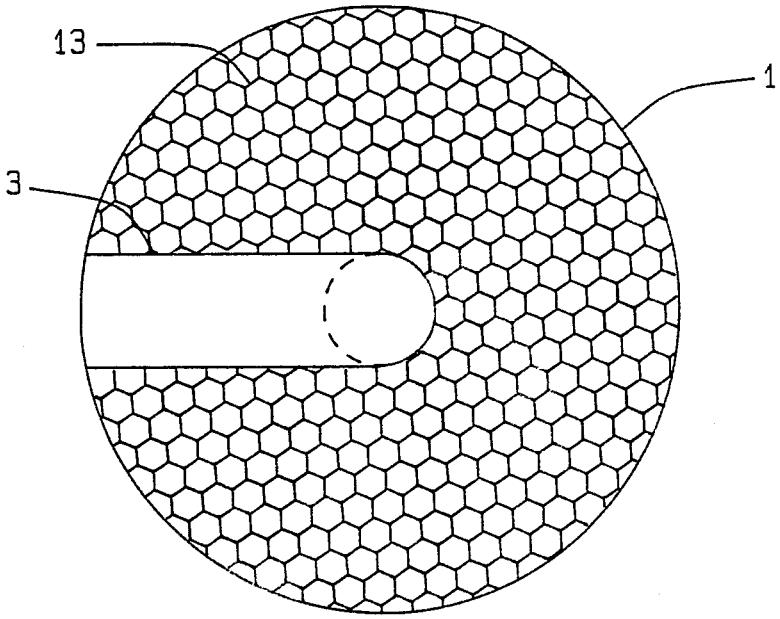
FIG. 3 is a view looking at the front of the cryopanel.

FIG. 3 is a view looking at the front of the cryopanel 1.

As shown in FIG. 3, the channel 3 is mounted rotatably on the surface of the cryopanel 1, applying heat to the surface as it moves. Means, such as a variable speed motor (not shown), is provided to vary the rate of rotation of the channel 3. Honeycomb structure 13, having a multitude of individual cells separated by their walls or partitions extending generally normal to and forming the plane of the cryopanel, is comprised of copper of a height and thickness sufficient to accommodate a combined heat load rate corresponding to the system's projected pumping capacity. Suitable alternative materials, such as aluminum, could be used.

The honeycomb surface 13 is shown here in cross-sections forming a pattern of adjacent hexagons. Alternate cell shapes may be used, including cross-sections in the form of squares or triangles.

Figure 4:
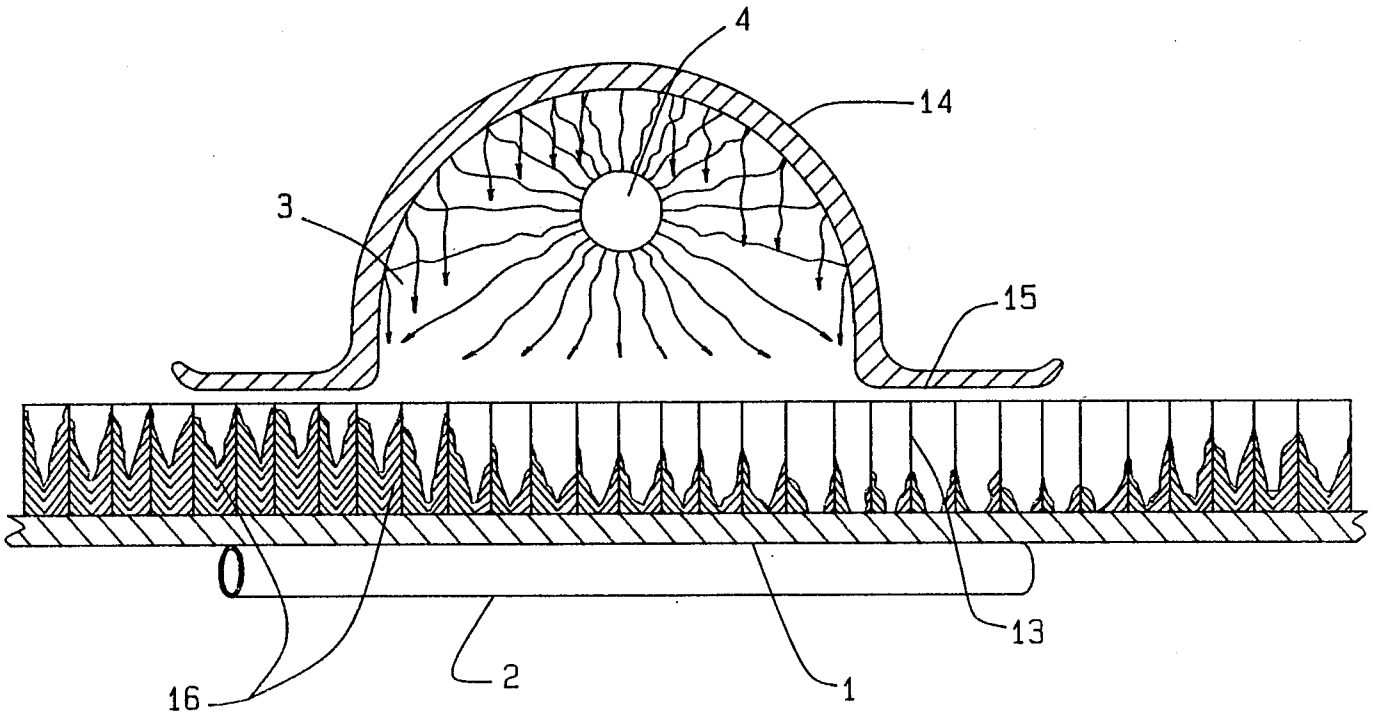
FIG. 4 is a cross-section through line 4—4 of FIG. 1.

As shown in FIG. 4, inside the omega-shaped channel 3 is a cartridge heater 4. Means, such as a rheostat 20, are provided to vary the power input to the cartridge heater 4. Heat inside channel 3 is isolated from the vacuum vessel by insulation material 14 on the outside of the channel 3. A lip seal 15 provides a small gap between the channel 3 and the cryopanel plane surface to minimize leakage of evolved gas from within the channel 3 into the high vacuum space.

Using the improved cryopumping system, a condensible gas is introduced into the evacuated vessel 12 and is conducted to a cryopanel 1 where it adheres as solidified gas 16. Cartridge heater 4 adds radiant energy to sublime the solidified gas. This gas is exhausted by an auxiliary pump (not shown) from channel 3 to atmosphere outside the vacuum tank. It could also be exhausted to a gas reclaiming system (not shown) from which it could be reintroduced into the vacuum system if required.

In this embodiment the gas used is argon, and the complementary refrigerant used is gaseous helium. Alternative condensible gases may be used in combination with complementary refrigerant fluids ranging upward in refrigeration temperature capacity to standard refrigerants such as the various freons.

The improved cryopumping system has several distinct advantages.

Radiant heat introduced into the cryopumping system has little effect on the pressure in the working space because it is sealed from the working space by insulation material 14 and by a lip seal 15.

Also, radiant heat introduced into the cryopumping system does not materially add to the heat load of the refrigerant system. Power input to the cartridge heater 4 and the rate of rotation of the channel 3 are preferably controlled so that a minimal but sufficient insulating layer of solidified gas 16 remains within the honeycomb structures 13, insulating the refrigerant tubes 2 from the radiant heat, without diminishing the pumping capacity of the cryopanel 1.

The presence of the honeycomb structure 13 in the cryopanel 1 enlarges the heat exchange surface in the cryopanel and adds to its effective area. Thus, the capacity of the cryopanel 1 is increased without significantly adding to its physical dimensions.

By controlling the power input to the cartridge heater 4 and the rate of rotation of the channel 3, the rate of sublimation can be controlled so that the solidified gas 16 is removed at an average rate equal to the rate of deposit, and pressure in the vacuum vessel 12 is substantially constant.

The embodiment of the invention in which an exclusive property or privilege is claimed is defined as follows:

1. A method for removing gases from a high vacuum environment, which comprises the steps of:

introducing gas at low pressure into an evacuated vacuum vessel;

conducting said gas to a circular cryopanel maintained at cryogenic temperatures;

selectively applying heat to portions of said cryopanel by means of a heater mounted within a channel which moves azimuthally around an axis located near the center of said cryopanel; and exhausting sublimed gas from said channel.

2. A method as defined in claim 1 wherein said gas introduced into said vacuum vessel is argon and said cryopanel is refrigerated by gaseous helium.

3. A method as defined in claim 1 wherein the power input to said heater is controlled to vary the rate of sublimation of the solidified gas.

4. A method as defined in claim 1 wherein the rate of rotation of said channel which moves azimithally around said axis is controlled to vary the rate of sublimation of the solidified gas.

5. A method as defined in claim 1 wherein said sublimed gas is exhausted by means of a blower/mechanical pump.

6. An apparatus for removing gases from a high vacuum environment, which comprises:

a vacuum vessel;

means for introducing gas at low pressure into said vacuum vessel;

a circular cryopanel within said vacuum vessel;

means for conducting said gas to said cryopanel;

means for maintaining said cryopanel at cryogenic temperatures;

channel means in juxtaposition to the cryopanel and mounted to move azimthally around an axis located near the center of said cryopanel;

heat means in said channel to sublime gas from said cryopanel, and means for exhausting the sublimed gas from said channel.

7. An apparatus as defined in claim 6 wherein the gas to be conducted into the vacuum vessel is argon and the means for maintaining the cryopanel at cryogenic temperatures comprises gaseous helium.

8. An apparatus as defined in claim 6 including sealing means to seal the interior of said channel from the surface of the cryopanel.

9. An apparatus as defined in claim 6 wherein said cryopanel comprises honeycomb structure having a multitude of individual cells separated by walls extending generally normal to and forming the plane of the cryopanel.

10. An apparatus as defined in claim 9 wherein the cells in said honeycomb structure are shaped in hexagons.

11. An apparatus as defined in claim 9 wherein the cells in said honeycomb structure are shaped in squares.

12. An apparatus as defined in claim 9 wherein the cells in said honeycomb structure are shaped in triangles.

13. An apparatus as defined in claim 9 wherein said honeycomb structure is comprised of a metal material of a height and thickness sufficient to accomodate a combined heat load rate corresponding to the system's projected capacity.

14. An apparatus as defined in claim 6 including means for controlling the rate of rotation of said channel to vary the rate of sublimation.

15. An apparatus as defined in claim 6 including means for controlling the power input to the heat means to vary the rate of sublimation.

16. An apparatus as defined in claim 6 wherein said means for exhausting the sublimed gas includes a blower/mechanical pump.

* * * * *